US005622543A

United States Patent [19]

Yang

[11] Patent Number: 5,622,543

[45] Date of Patent: Apr. 22, 1997

[54] RECTILINEAR TURBULENT FLOW TYPE AIR PURIFIER

[76] Inventor: Chen-Ho Yang, No. 12, Lane 780, Cheng Kung Road, Hsi Hu Zhen, Chang Hua City, Taiwan

[21] Appl. No.: 530,621

[22] Filed: Sep. 20, 1995

[51] Int. Cl.[6] ..... B03C 3/011; B03C 3/155

[52] U.S. Cl. ..... 96/58; 55/485; 96/81; 96/97

[58] Field of Search ..... 96/80–82, 57–59, 96/26, 97; 55/485, 486, 506, 385.2

[56] References Cited

U.S. PATENT DOCUMENTS

| | | | |
|---|---|---|---|
| 3,438,180 | 4/1969 | Klouda | 96/58 |
| 3,626,668 | 12/1971 | Cardiff | 96/81 X |
| 3,654,747 | 4/1972 | Remick | 96/58 |
| 3,733,783 | 5/1973 | Burney | 96/81 X |
| 4,341,537 | 7/1982 | Rodgers | 96/81 X |
| 4,597,781 | 7/1986 | Spector | 55/485 X |
| 5,035,728 | 7/1991 | Fang | 96/58 X |
| 5,123,936 | 6/1992 | Stone et al. | 96/57 X |
| 5,322,550 | 6/1994 | Park | 96/97 X |
| 5,456,741 | 10/1995 | Takahara et al. | 96/59 X |
| 5,492,557 | 2/1996 | Vanella | 96/97 X |

*Primary Examiner*—Richard L. Chiesa

*Attorney, Agent, or Firm*—Beveridge, DeGrandi, Weilacher & Young, L.L.P.

[57] ABSTRACT

An air purifier including a housing, a front cover, a front wire gauze filter, an anion generating pin board, a dust collector, and an active carbon filter, wherein: the housing has a plurality of parallel tracks horizontally disposed at different elevations for mounting the front wire gauze filter, the anion generating pin board, the dust collector, and the active carbon filter, a plurality of arched metal springs fixedly fastened to the parallel tracks for connecting power supply to the anion generating pin board and the dust collector, a side cover, and a micro switch which turns on power supply when the side cover is installed, or to turn off power supply when the side cover is removed from the housing; the dust collector has a plurality of equally spaced round holes over the whole area thereof, and is controlled to produce positive ions; the anion generating pin board has a plurality of triangular projecting plates perpendicularly raised from one side thereof and respectively aimed at the center of every four adjacent round holes of the dust collector, and is controlled to produce negative ions.

2 Claims, 3 Drawing Sheets

RECTILINEAR TURBULENT FLOW TYPE AIR PURIFIER

BACKGROUND OF THE INVENTION

The present invention relates to a rectilinear turbulent flow type air purifier which comprises a housing, a front cover, a front wire gauze filter, an anion generating pin board, a dust collector, and an active carbon filter, wherein: the housing has a plurality of parallel tracks horizontally disposed at different elevations for mounting the front wire gauze filter, the anion generating pin board, the dust collector, and the active carbon filter, a plurality of arched metal springs fixedly fastened to the parallel tracks for connecting power supply to the anion generating pin board and the dust collector, a side cover, and a micro switch which turns on power supply when the side cover is installed, or to turn off power supply when the side cover is removed from the housing; the dust collector has a plurality of equally spaced round holes over the whole area thereof, and is controlled to produce positive ions; the anion generating pin board has a plurality of triangular projecting plates perpendicularly raised from one side thereof and respectively aimed at the center of every four adjacent round holes of the dust collector, and is controlled to produce negative ions.

Various air purifiers have been disclosed, and have appeared on the market. Regular air purifiers generally comprise a metal wire gauze filter, an ion generator, a dust collector, an active carbon filter, and and anion generating board. When in use, foul air passes through the ion generator to carry positive ions. The dust collector is comprised of a plurality of dust collecting boards of different poles alternatively arranged in parallel for collecting dust from air passing through. Because dust tends to be collected at the front side of the dust collector, the dust collector will be blocked up quickly. Therefore the dust collector must be frequently cleaned. If the dust collector does not work properly, the active carbon filter must work heavily, and the working efficiency of the air purifier will be affected. Because foul air contents particles and toxic gases, it is harmful to the health if it is directly taken into the lungs without being purified or well purified.

SUMMARY OF THE INVENTION

The present invention has been accomplished to provide an air purifier which effectively purifies foul air passing through.

According to one aspect of the present invention, the air purifier is comprised of a housing, a front cover, a front wire gauze filter, an anion generating pin board, a dust collector, and an active carbon filter, wherein: the housing has a plurality of parallel tracks horizontally disposed at different elevations for mounting the front wire gauze filter, the anion generating pin board, the dust collector, and the active carbon filter, a plurality of arched metal springs fixedly fastened to the parallel tracks for connecting power supply to the anion generating pin board and the dust collector, a side cover, and a micro switch which turns on power supply when the side cover is installed, or to turn off power supply when the side cover is removed from the housing; the dust collector has a plurality of equally spaced round holes over the whole area thereof, and is controlled to produce positive ions; the anion generating pin board has a plurality of triangular projecting plates perpendicularly raised from one side thereof and respectively aimed at the center of every four adjacent round holes of the dust collector, and is controlled to produce negative ions.

According to another aspect of the present invention, the housing comprises a high-voltage generator at one side for producing a magnetic field, a horizontal air output port at the front side, transverse fan near the back side for drawing purified air out of the air output port.

According to still another aspect of the present invention, the anion generating pin board further has a plurality of rhombic holes adjacent to each triangular projecting plate.

DETAILED DESCRIPTION OF THE PREFERRED EMBODIMENT

Figures 1, 2:
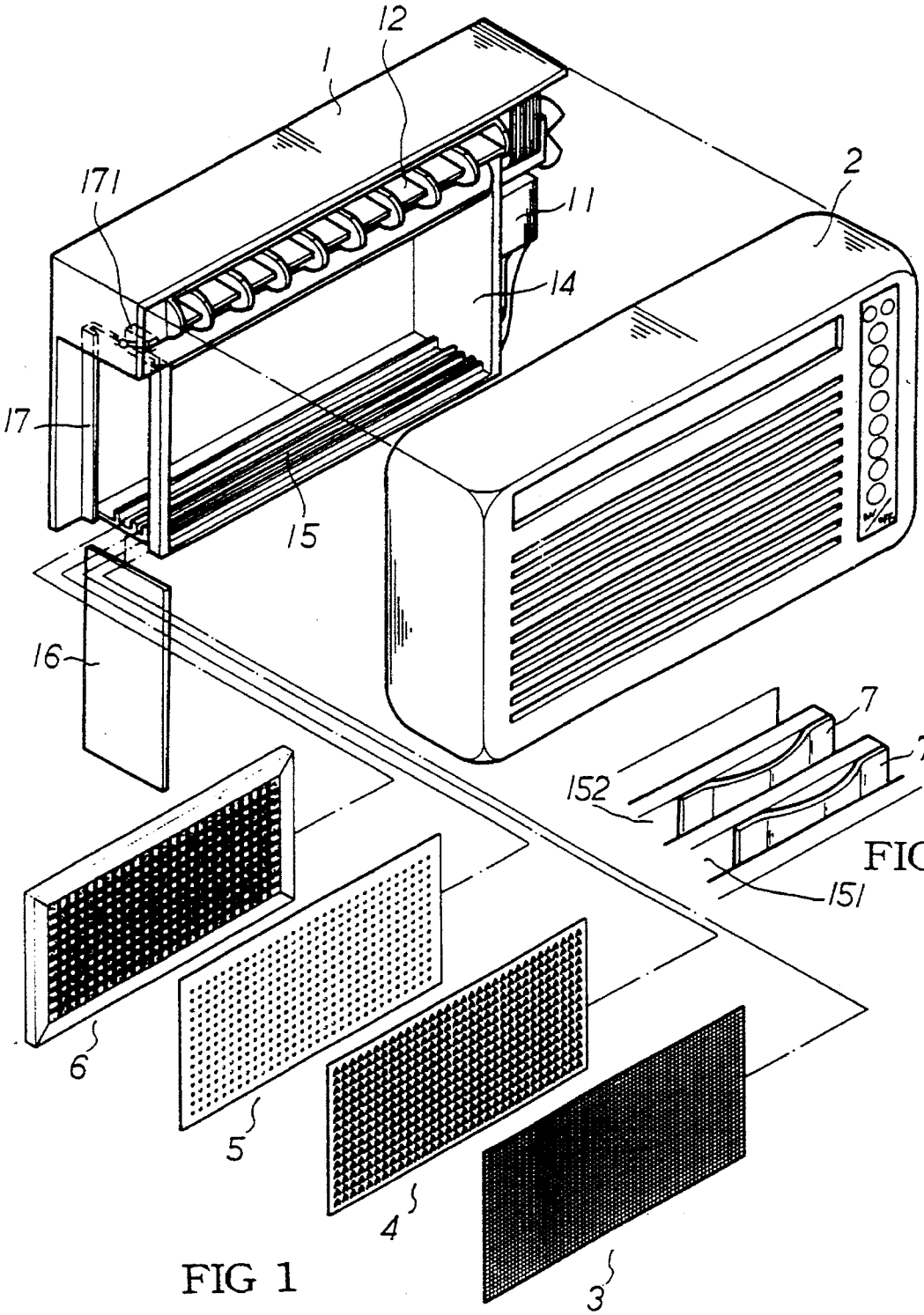
FIG. 1 is an exploded view of an air purifier according to the present invention.
FIG. 2 is an enlarged view showing the arched metal plates installed in the sliding track of the housing according to the present invention.
Figure 3:
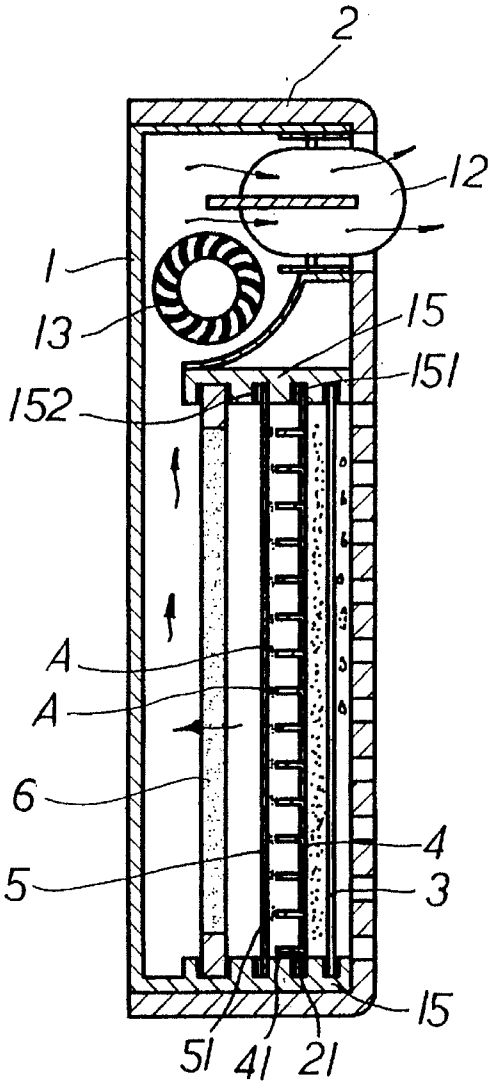
FIG. 3 is a side view in section of the air purifier according to the present invention.

Referring to FIGS. 1, 2, and 3, an air purifier in accordance with the present invention is generally comprised of a housing 1, a front cover 2, a front wire gauze filter 3, an anion generating pin board 4, a dust collector 5, an active carbon filter 6. The housing 1 comprises a high-voltage generator 11 at one lateral side, a horizontal air output port 12 at the top, a transverse fan 13 at the back, and a chamber 14 at the bottom. The chamber 14 has parallel sliding tracks 15 respectively raised from the top and bottom sides thereof for mounting the front wire gauze filter 3, the anion generating pin board 4, the dust collector 5, and the active carbon filter 6. Arched contact metal plates 7 are respectively fixedly fastened to the sliding track 151 for the anion generating pin plate 4 and the sliding track 152 for the dust collector 5. When the front wire gauze filter 3, the anion generating pin board 4, the dust collector 5, and the active carbon filter 6 are respectively fastened to the respective sliding tracks 15, a sliding side cover 16 is inserted into a vertical side track 17 on the housing 1 to stop the front wire gauze filter 3, the generating pin board 4, the dust collector 5, and the active carbon filter 6 in place. A micro switch 171 is installed in the vertical side track 17 at the top end, which automatically cuts off power supply when the sliding side cover 16 is removed from the housing 1.

Figure 5:
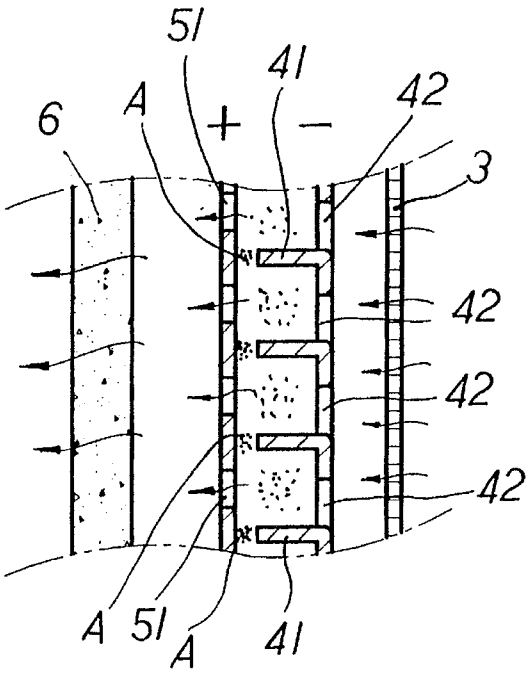
FIG. 5 is a schematic drawing showing foul air purified by the front wire gauze filter, the anion generating pin board, the dust collector, and the active carbon filter according to the present invention.
Figure 4A:
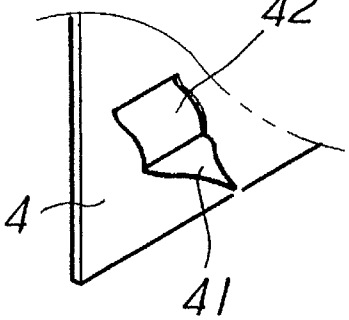
FIG. 4A is partially enlarged view of the front and back sides of the anion generating pin board according to the present invention.
Figure 4:
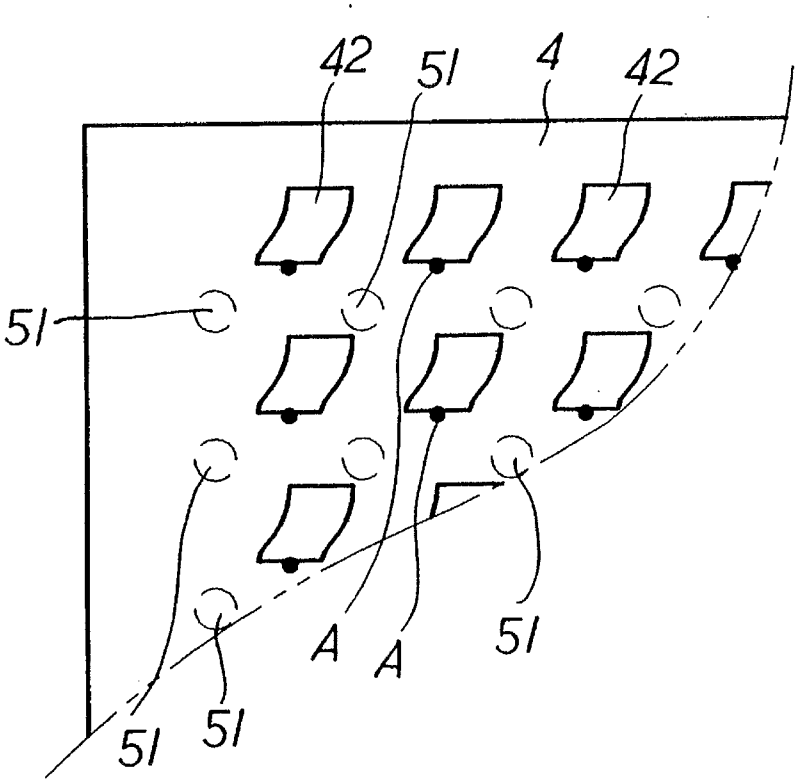
FIG. 4 is a schematic drawing showing the positions of the triangular projecting plates of the anion generating pin board relative to the round holes of the dust collector according to the present invention.

Referring to FIGS. 4, 4A, and 5, when foul air passes from the front wire gauze filter 3 through the anion generating pin board 4, it is purified by ozone, which is accumulated at the space between the front wire gauze filter 3 and the anion generating pin board 4. The anion generating pin board 4 has a plurality of rhombic holes 42 and a plurality of triangular projecting plates 41 respectively perpendicularly raised from the rhombic holes 42 at one side. When the anion generating pin board 4 is fastened to the sliding track 151, it is disposed in contact with the respective arched contact metal plate 7, causing the triangular projecting plates 41 to discharge charges, which decompose carbon element of carbon dioxide. Decomposed carbon dust is then gathered at the dust collector 5. The dust collector 5 has a plurality of equally spaced round holes 51, and is disposed in contact with the respective arched contact metal plate 7 to produce cations when it is fastened to the sliding track 152. When the high-voltage generator 11 is electrically connected, a magnetic field is produced. Because positive charge and negative charge will attract each other, dust forms into negative ions when it passes through the anion generating pin board 4. The triangular projecting plates 41 of the anion generating pin board 4 are respectively aimed at the center A among each four adjacent round holes 51 of the dust collector 5. Filtered air flows backwards through the round holes 51, and is then filtered by the active carbon filter 6. Purified air is finally drawn away from the housing 1 through the horizontal air output port 12 by the transverse fan 13.

Figure 6:
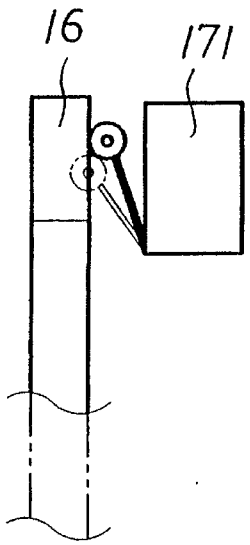
FIG. 6 shows the operation of the micro switch relative to the side cover according to the present invention.

Referring to FIG. 6, when the front wire gauze filter 3, the anion generating pin board 4, the dust collector 5, and the active carbon filter 6 are respectively fastened to the respective sliding tracks 15, a sliding side cover 16 is inserted into the vertical side track 17 from the bottom side to stop the front wire gauze filter 3, the front wire gauze filter 3, the anion generating pin board 4, the dust collector 5, and the active carbon filter 6 in place. When the sliding side cover 16 is installed, the micro switch 171 is turned on to connect power supply to the electric circuit of the air purifier. On the contrary, when the sliding side cover 16 is moved away from the vertical side track 17 of the housing 1, the micro switch 171 is turned off to cut off power supply from the air purifier. Therefore, touching the anion generating pin board 5 and the dust collector 5 does not cause an electric shock when the sliding side cover 16 is removed from the housing 1.

Figure 7:
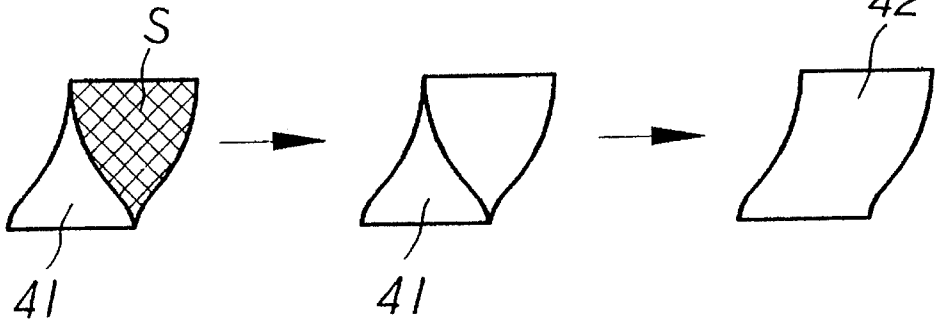
FIG. 7 shows the production flow of the triangular projecting plates and rhombic holes of the anion generating pin board according to the present invention.

Referring to FIG. 7, the triangular projecting plates 41 and rhombic holes 42 of the anion generating pin board 4 are formed by: making triangular portions S on the anion generating pin board 4 by punching, then making triangular projecting plates 41 corresponding to the triangular portions S and simultaneously disconnecting the triangular portions S from the anion generating pin board 4 so as to form rhombic holes 42 on it.

It is to be understood that the drawings are designed for purposes of illustration only, and are not intended as a definition of the limits and scope of the invention disclosed.

I claim:

1. An air purifier comprised of a housing, a front cover, a front wire gauze filter, an anion generating pin board, a dust collector, and an active carbon filter, wherein: said housing comprises a plurality of parallel tracks horizontally disposed at different elevations for mounting said front wire gauze filter, said anion generating pin board, said dust collector, and said active carbon filter, a plurality of arched metal springs fixedly fastened to said parallel tracks for connecting power supply to said anion generating pin board and said dust collector, a vertical side track for mounting a side cover to stop said front wire gauze filter, said anion generating pin board, said dust collector, and said active carbon filter in said parallel tracks, a micro switch for ON/OFF power supply, said micro switch being triggered to turn on power supply when said side cover is installed, or to turn off power supply when said side cover is removed from said vertical side track; said dust collector has a plurality of equally spaced round holes over the whole area thereof, and is controlled to produce positive ions; said anion generating pin board has a plurality of triangular projecting plates perpendicularly raised from one side thereof and respectively aimed at the center of every four adjacent round holes of said dust collector, and is controlled to produce negative ions.

2. The air purifier of claim 1 wherein said anion generating pin board further has a plurality of rhombic holes adjacent to each triangular projecting plate.

* * * * *